US007325710B1

(12) United States Patent
Wen

(10) Patent No.: US 7,325,710 B1
(45) Date of Patent: Feb. 5, 2008

(54) PNEUMATIC NAIL GUN

(75) Inventor: Wan-Fu Wen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 0 days.

(21) Appl. No.: 11/563,162

(22) Filed: Nov. 25, 2006

(30) Foreign Application Priority Data

Oct. 24, 2006 (TW) ..... 95139140 A

(51) Int. Cl.
*B25C 1/04* (2006.01)

(52) U.S. Cl. ..... 227/130; 227/120; 91/422

(58) Field of Classification Search ..... 227/9, 227/10, 129, 130, 150, 156, 8, 119, 120; 91/422, 426
See application file for complete search history.

(56) References Cited

U.S. PATENT DOCUMENTS 3,190,187 A * 6/1965 Doyle ..... 91/403
3,673,922 A * 7/1972 Doyle ..... 91/422
3,715,069 A * 2/1973 O'Conner ..... 227/130
4,294,391 A 10/1981 Obergfell
4,319,705 A * 3/1982 Geist et al. ..... 227/120
4,403,722 A * 9/1983 Nikolich ..... 227/8
4,436,237 A * 3/1984 Vornberger et al. ..... 227/130
4,483,473 A * 11/1984 Wagdy ..... 227/8
4,549,344 A * 10/1985 Nikolich ..... 29/432
4,717,060 A * 1/1988 Cotta ..... 227/10
4,721,240 A * 1/1988 Cotta ..... 227/10
4,784,308 A * 11/1988 Novak et al. ..... 227/130
4,913,331 A * 4/1990 Utsumi et al. ..... 227/10
5,181,450 A * 1/1993 Monacelli ..... 91/41
5,687,898 A * 11/1997 Toulouse ..... 227/8
5,873,510 A * 2/1999 Hirai et al. ..... 227/130
6,006,975 A 12/1999 Ishizawa
6,102,270 A * 8/2000 Robinson ..... 227/10
6,145,727 A * 11/2000 Mukoyama et al. ..... 227/130
6,533,156 B1 3/2003 Chang
6,779,699 B2 * 8/2004 Aoki et al. ..... 227/130
7,131,563 B2 * 11/2006 Wen ..... 227/130
2005/0173486 A1 * 8/2005 Moeller et al. ..... 227/10
2006/0016845 A1 * 1/2006 Ishizawa et al. ..... 227/130
2006/0157529 A1 * 7/2006 Lee ..... 227/130

* cited by examiner

*Primary Examiner*—Rinaldi I. Rada
*Assistant Examiner*—Paul Durand

(57) ABSTRACT

A pneumatic nail gun includes a gun body having a cylinder therein; a hitting piston disposed in the cylinder; a main air housing collecting high pressure air; a trigger at one end of the main air housing; a main passage disposed at a peripheral portion of the cylinder, the main passage being connecting with the main air housing for gathering high pressure air therein; and a bottom valve disposed at a bottom peripheral portion of the cylinder, the bottom valve being driven to upwardly move for continuously guiding high pressure air into the bottom chamber to drive the hitting piston upwardly move to reposit when the trigger is released. When the high pressure air in the main passage is recharged, the bottom valve is driven by the high pressure air gathered in the main passage to move downward to reposit after the hitting piston being reposited.

10 Claims, 8 Drawing Sheets

PNEUMATIC NAIL GUN

BACKGROUND

The present invention relates to pneumatic nail guns, and particularly to a pneumatic nail gun having a main passage and a bottom valve disposed at a peripheral portion of a fixed cylinder of the nail gun, for continuously guiding compressed high pressure air to drive a hitting piston of the nail gun upwardly reposit.

The pneumatic nail gun generally utilizes a compressed high pressure air to drive nails to punch, which is a gun-shaped pneumatic tool, and has been widely used in nailing woodworkers.

A typical pneumatic nail gun has a gun body, and a fixed or a moveable cylinder disposed in the gun body, which is used to control the compressed high pressure air to drive a piston in the cylinder to downwardly hit nails as well as upwardly reposit.

The related arts, such as U.S. Pat. No. 6,533,156, U.S. Pat. No. 6,779,699 and U.S. Pat. No. 6,006,975 respectively disclosed a typical pneumatic nail gun employing a fixed cylinder. The pneumatic nail gun includes a head valve disposed upon the fixed cylinder, and a trigger of the nail gun may drive the high pressure air to open the head valve so as to guide the high pressure air into the cylinder for driving the hitting piston downwardly move to hit nails. The nail gun also includes a return passage having a certain capacity disposed at a peripheral portion of the cylinder, and the return passage can guide high pressure air thereinto during the process of hitting nails by the hitting piston, and then the limited high pressure air in the return passage can drive the hitting piston upwardly move to reposit after hitting nails. However, the return passage can only collect compressed air during the hitting piston downwardly moving to hitting nails, which can not continuously guiding compressed air thereinto and maintaining a high pressure therein. Therefore, the pushing force generated by the limited compressed air in the return passage may not ensure the hitting piston having a stable reposition process. During the process of continuously hitting nails, slower and unstable reposition of the hitting piston may impact the speed and efficiency of hitting nails.

Other related arts, such as U.S. Pat. No. 4,784,308, U.S. Pat. No. 4,319,705 and U.S. Pat. No. 4,294,391 respectively disclosed a pneumatic nail gun overcome the above-mentioned problems. These nail guns includes a hitting piston induced by a valve, and a moveable cylinder. The residual compressed air in a bottom portion of the cylinder may be exhausted to atmosphere and high pressed air may be introduced into the bottom portion of the cylinder to driver the hitting piston upwardly move to reposit. On the other hand, these patents also disclosed valve mechanisms to substitute of return passages, for use in continuously guiding high pressure air into main air housing and a bottom chamber to drive the hitting piston upwardly move to reposit via opening passages of the main air housing and the bottom chamber when the trigger is released. However, the valve mechanisms are disposed in the gun body far away from the cylinder, it request that the gun body has a larger space and complicated passages to realize introducing the high pressure air into the bottom chamber to drive the hitting piston upwardly move to reposit. Therefore, the nail gun has a high manufacturing cost and complicated air flow passages.

Accordingly, what is needed is a pneumatic nail gun that can overcome the above-described deficiencies.

BRIEF SUMMARY

A pneumatic nail gun of the present invention can overcome the problems of lacking of pushing force of the pressure air for reposition of hitting piston, which can also save the space inside the nail gun to distribute mechanism as well as has a simple air flow passage distribution so as to ensure the nail gun having a lower cost and a high facility for operation.

The present invention provides a pneumatic nail gun comprising a gun body, at least one main passage, a bottom valve. The gun body has a unmovable cylinder therein, a hitting piston disposed in the cylinder, the hitting piston dividing the cylinder into a top chamber and a bottom chamber, a main air housing collecting a compressed high pressure air with a constant pressure, and a trigger at one end of the main air housing driving the high pressure air to hit a nail. The at least one main passage is disposed at a peripheral portion of the cylinder or a side of the main air housing. The at least one main passage is connected with the main air housing for introducing and gathering high pressure air therein, the high pressure air in the main passage being discharged after the hitting piston hitting the nail before reposting. The bottom valve is disposed at a bottom peripheral portion of the cylinder. The bottom valve is driven to upwardly move for continuously guiding high pressure air into the bottom chamber of the cylinder to drive the hitting piston upwardly move to reposit when the trigger is released. The high pressure air in the main passage is recharged, and the bottom valve is driven by the high pressure air gathered in the main passage to move downward to reposit after the hitting piston being reposited.

The pneumatic nail gun has a main passage to substitute of the return passage for continuously guiding the compressed air to drive the hitting piston to upwardly move to reposit. Moreover, this pneumatic nail gun employs the main passage and a bottom valve to substitute of the conventional valve mechanisms and the passages, in which, the main passage and the bottom valve are both disposed at a peripheral portion of the nail gun for simplifying the distribution of the nail gun, so as to improve the operating facility of the nail gun and lower the cost thereof.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
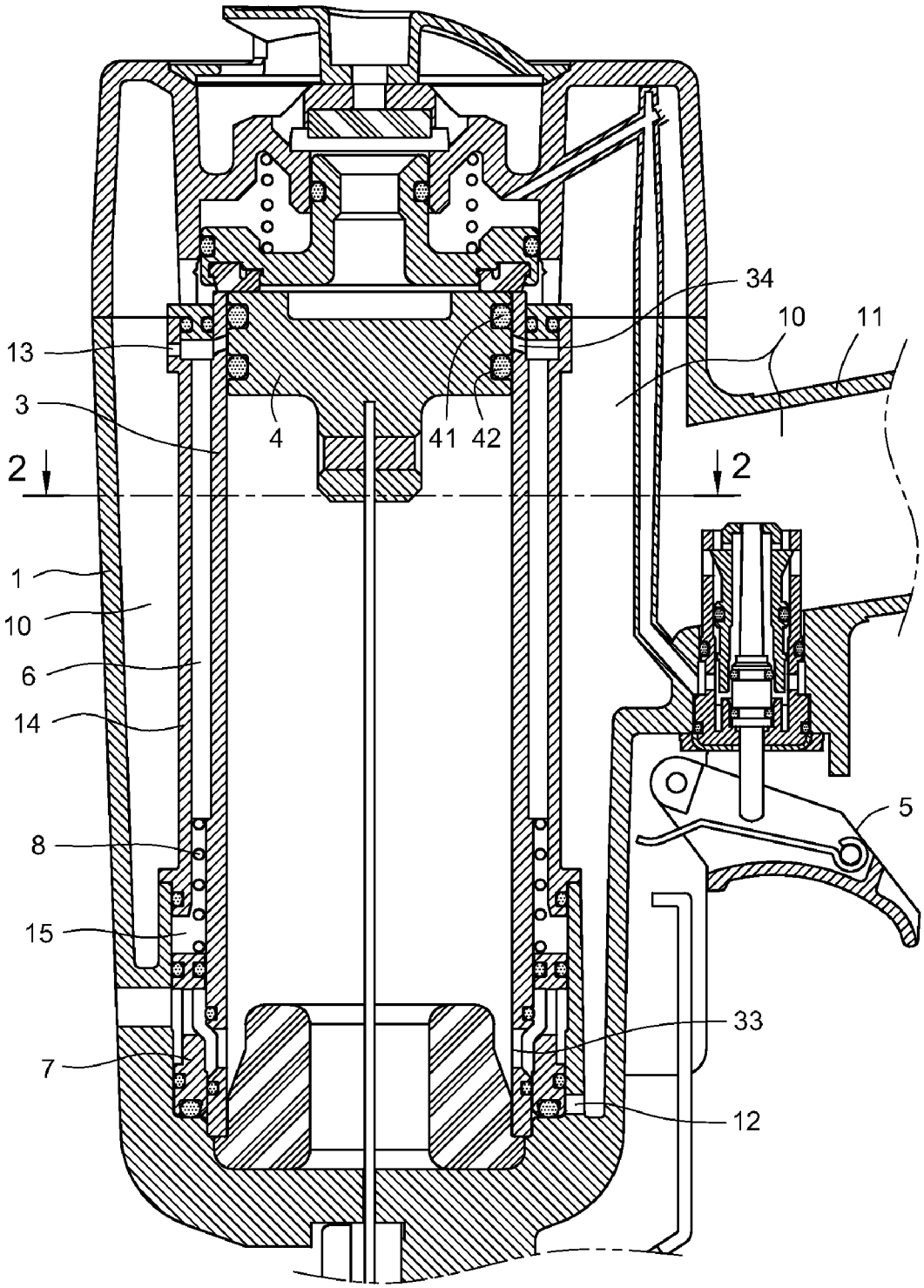
FIG. 1 is a, side, cross-sectional view of part of a pneumatical nail gun according to a first embodiment of the present invention, showing a main passage and a bottom valve disposed at a peripheral portion of a cylinder thereof.
Figure 2:
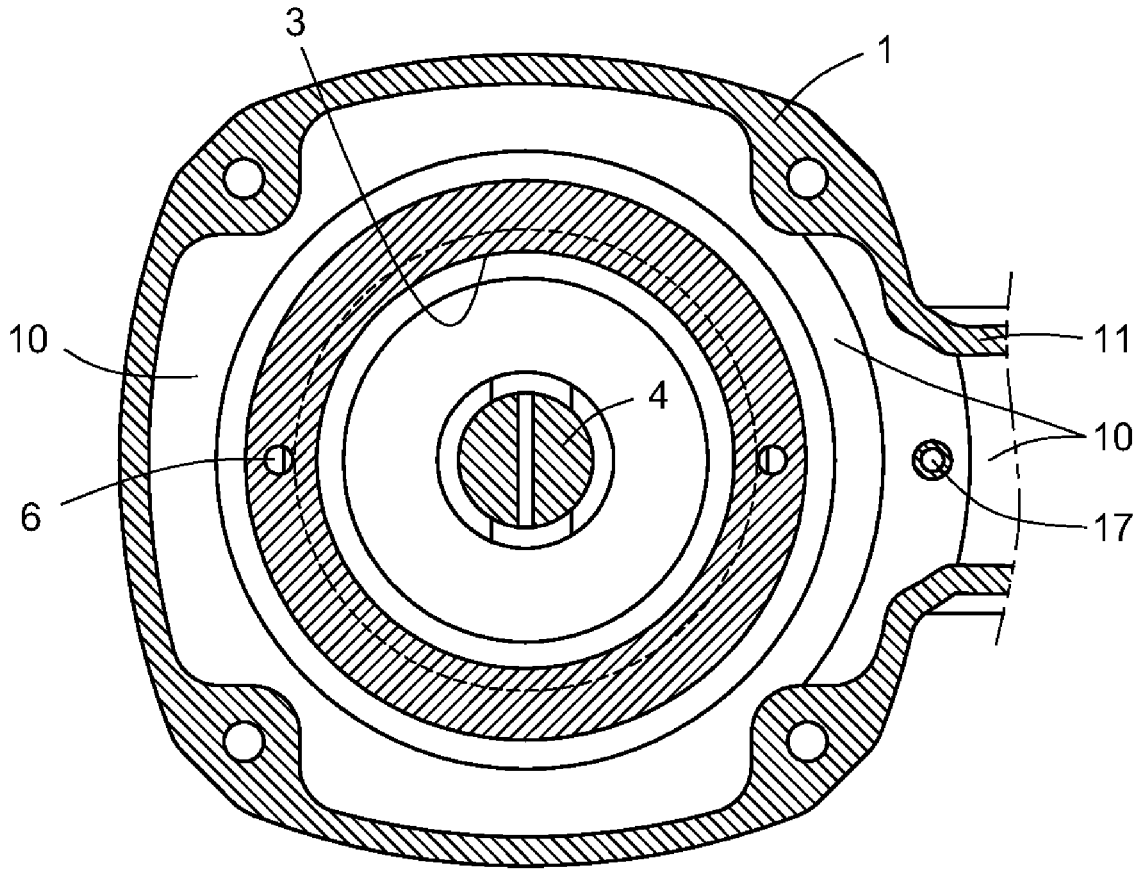
FIG. 2 is a cross-sectional view taken along the line 2-2 of FIG. 1.

Referring to FIGS. 1 to 6, a pneumatic nail gun according to a first embodiment of the present invention is shown. The pneumatic nail gun has a gun body 1, an immovable cylinder 3, a hitting piston 4 disposed in the immovable cylinder 3, a main air housing 10 disposed in the nail gun, at least one main air flow passage 6, and a bottom valve 7.

The hitting piston 4 includes at least two air tight rings 41 and 42, which can divide the cylinder 3 into a top chamber 31 and a bottom chamber 32 when the hitting piston 4 move downward to hit nails or move upward to reposit.

The main air housing 10 is disposed between a handle 11 of the nail gun and the peripheral portion of the cylinder 3 for gathering continuously introducing high pressure air from atmosphere via a free end of the handle 11. The main air housing 10 further includes a trigger 5 disposed at one end of the main air housing 10 for driving the hitting piston 4 downwardly move to hit nails and upwardly reposit.

There may be a plurality of main air flow passages 6 disposed at a peripheral portion of the cylinder 3, which is connected with the main air housing 10 for guiding the high pressure air in the main air housing 10 into the main air flow passages 6. After the hitting piston 4 move downward to hit nails and before reposition, the compressed high pressure air in the main passages 6 is exhausted to top chamber 31.

The bottom valve 7 is disposed at a peripheral and lower portion of the cylinder 3, when the trigger 5 is released and the high pressure air in the main passage 6 is exhausted, the bottom valve 7 is driven by the high pressure air and upwardly move so as to guide high pressure air continuously into the bottom chamber 32 to drive the hitting piston 4 upwardly move. After the hitting piston 4 is reposited, the bottom valve 7 is driven by the compressed high pressure air in the main passage 6 to downwardly move to reposited.

The nail gun further includes at least a bottom through hole 12 disposed at a bottom portion in the gun body 1 adjacent to a bottom portion of the bottom valve 7. When the hitting piston 4 moves downward to hit nails and the top chamber 31 is closed, the bottom through hole 12 is used for guiding the high pressure air in the main air housing 10 to drive the bottom valve 7 to upwardly move.

The nail gun further includes a plurality of bottom valve holes 33 disposed at side wall of the cylinder 3 adjacent to a bottom portion thereof. When the bottom valve 7 moves downward to reposit, the bottom valve holes 33 shuts off the fluid communication of the high pressure air into the bottom air chamber 32.

The cylinder 3 further includes at least one top valve hole 34 disposed at side walls thereof adjacent to a top portion of the cylinder 3. The top valve hole 34 is opened when the hitting piston 4 moves down to hit nails and before reposition, the high pressure air in the main passage 6 are exhausted. When the hitting piston 4 reposits, the top valve hole 34 is closed to gather high pressure air in the main passage 6. Moreover, the main passage 6 includes a top through hole 13 disposed at a side thereof, and the top through hole 13 has a cross-section smaller than that of the top valve hole 34. Furthermore, the main passage 6 is disposed between an outside surface of the cylinder 3 and a side wall 14 of the gun body 1, and the side wall 14 is disposed between the main passage 6 and the main air housing 10, and the top through hole 13 is disposed on the side wall 14 of the gun body 1.

In addition, the nail gun further includes a lower air chamber 15 disposed upon the bottom valve 7 and between a peripheral portion of the cylinder 3 and the inner side wall of the gun body 1. The lower air chamber 15 is connected with the main passage 6 for gathering high pressure air to drive the bottom valve 7 to move downward to reposit. Wherein, the lower air chamber 15 may includes a bottom spring 8 installing therein and abutting the bottom valve 7, and the bottom spring 8 provides a push force less than that of the high pressure air gathering in the main air housing 10 for driving the bottom valve 7 upwardly move. The bottom spring 8 may be selected to dispose at a peripheral position of the bottom valve 7 that is conveniently to abut the bottom valve 7 no matter where the lower air chamber 15 is provided.

Figure 7:
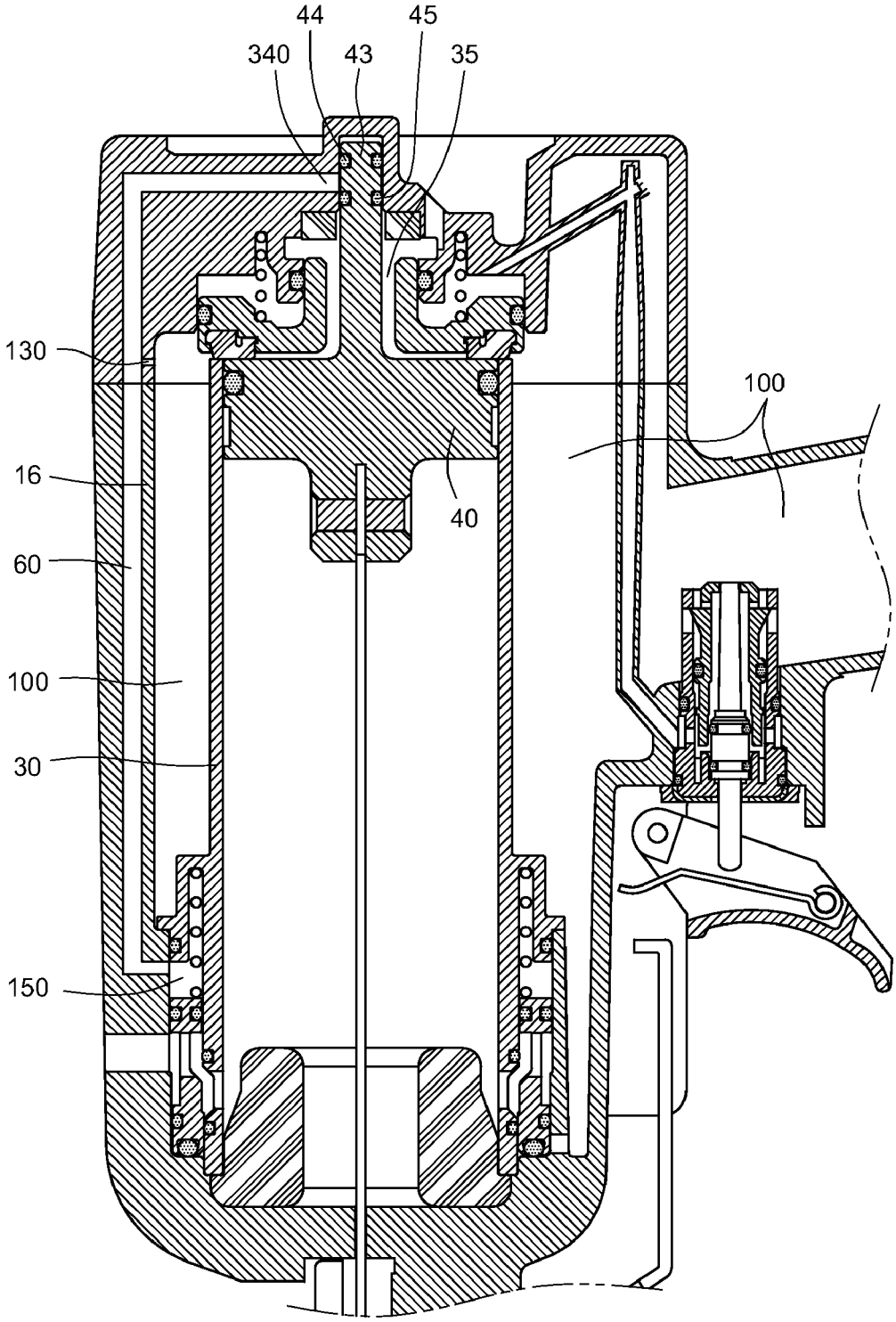
FIG. 7 is a side, cross-sectional view of a part of a pneumatical nail gun according to a second embodiment of the present invention, showing a main air flow passage disposed adjacent to a side of the main air housing, and a top chamber including a concave chamber at a top portion thereof, a top through hole being connected with the concave chamber for engaging with a valve bolt, the valve bolt for use in controlling open and close of the concave chamber.

Referring to FIG. 7, a pneumatic nail gun according to a second embodiment of the present invention is shown. The pneumatic nail gun has a structure similar to that of the nail gun of the first embodiment. However, this nail gun includes only one main passage 60 disposed at a side of the main air housing 100. The main passage 60 is disposed at an outside of a rib wall 16 in the gun body that formed by the main air housing 100, and a top through hole 130 is disposed on the rib wall 16. A concave chamber 35 is formed at a top portion of the top chamber that is extended therefrom, and a top valve hole 340 is connected with the concave chamber 35 and is taken as one end of the main passage 60. A valve bolt 43 is extended from a top portion of a piston 40, which is capable of passing in and out of the concave chamber 35. The valve bolt 43 includes at least two airtight rings 44 and 45 for opening or closing the valve hole 340. The other end of the main passage 60 is connected with the lower chamber 150. With these configurations, the cylinder 30 has no valve holes disposed at side walls of the cylinder 30 adjacent to a top portion thereof. This nail gun can realize the function similar to the nail gun of the first embodiment according to the present invention.

Figure 8:
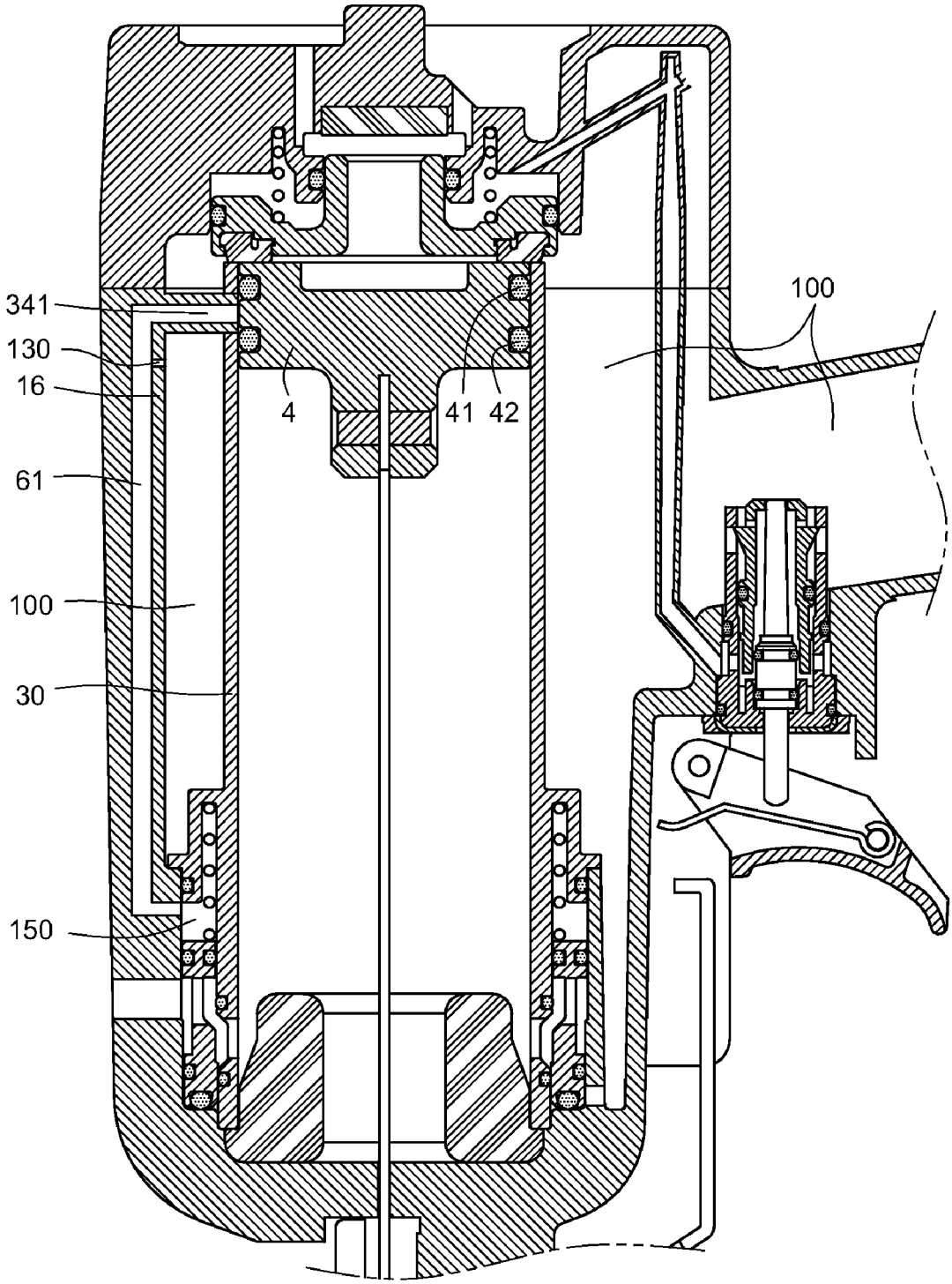
FIG. 8 is a side, cross-sectional view of a part of a pneumatical nail gun according to a third embodiment of the present invention, showing a main air flow passage disposed adjacent to a side of the main air housing, and a top through hole being connected with the main air housing, a piston controlling open and close of the main air housing via inducing the top through hole.

Referring to FIG. 8, a pneumatic nail gun according to a third embodiment of the present invention is shown. The nail gun has a structure similar to that of the nail gun according to the second embodiment. The main passage 61 has a valve hole 341 connecting with the side wall of the cylinder 30 adjacent to a top portion thereof. The air tight rings 41 and 42 control the opening and closing of the valve hole 341. The nail gun has no concave chamber and valve bolt. This nail gun can realize the function similar to the nail gun of the second embodiment according to the present invention.

Figure 3:
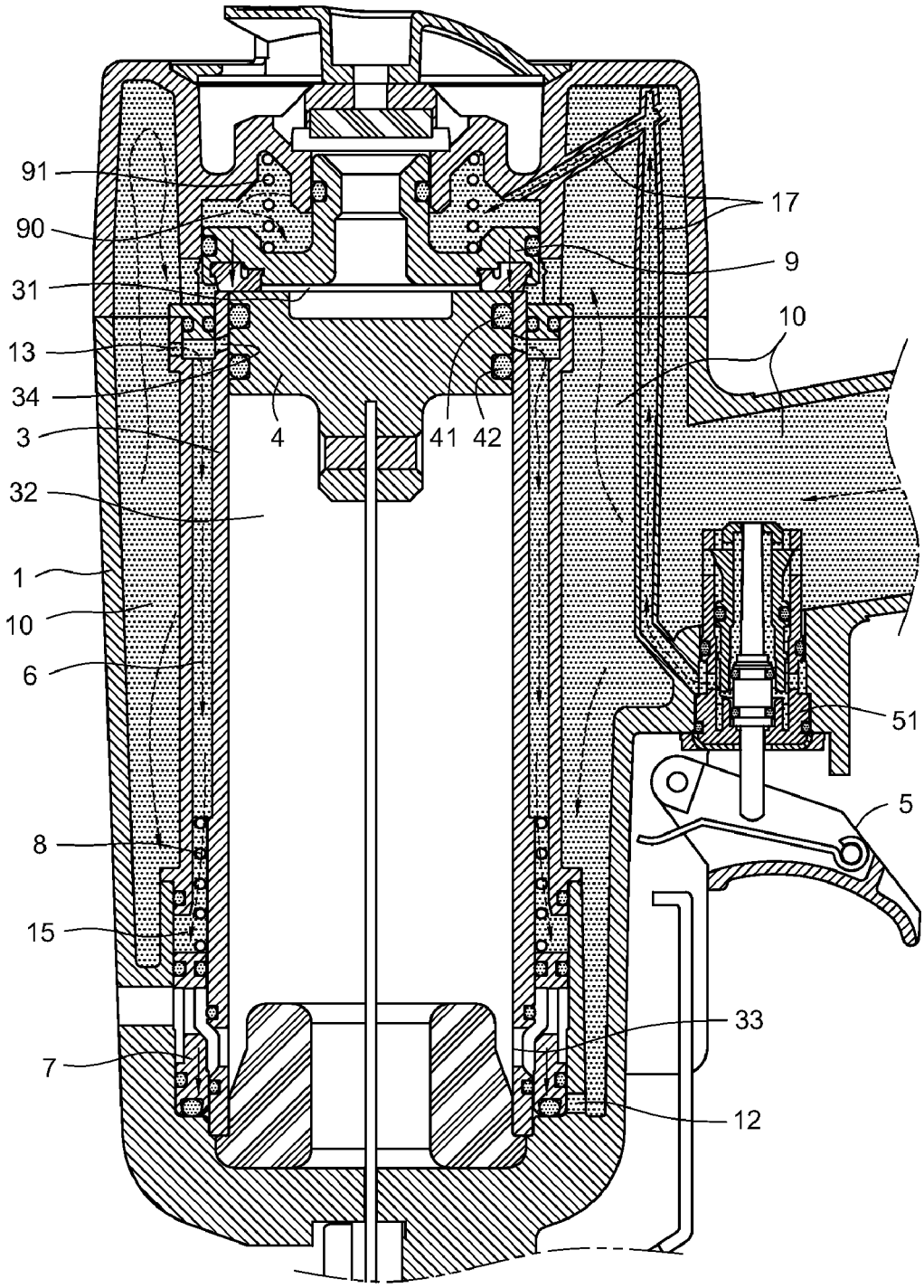
FIG. 3 is another cross-sectional view of the pneumatical nail gun of FIG. 1, showing a state of high pressure air gathered in a main air housing, a top chamber, and a main air flow passage.

In operation, taking the nail gun of the first embodiment as an example, before the trigger 5 is manipulated as shown in FIG. 3, compressed air in the main air housing 10 is applied to the upper air chamber 90 through the trigger valve 51 and the trigger passage 17. Therefore, the high pressure air in the upper air chamber 90 and the top spring 91 drive the head valve 9 to close the fluidly communication between the top chamber 31 and the main air housing 10, and the top exhausting hole 19 is opened to make the top air chamber 31 connect with the atmosphere. On the other hand, the high pressure air in the main air housing 10 may introduce into the bottom of the bottom valve 7 via the bottom through hole 12, and also may introduce and gather in the main passage 6 via the top through hole 13. The pushing force of the high pressure air in the main passage 6 or combined with the force of the bottom spring 8 are larger than that of the high pressure air gathered at the bottom valve 7. Therefore, the bottom valve 7 is driven to downwardly move to close the fluidly communication between the bottom chamber 32 and the main air housing 10 via the bottom valve holes 33. At the same time, the air tight rings 41 and 42 of the hitting piston 4 closes the top valve holes 34 to close the fluid communication between the top air chamber 31 and the main passage 6.

Figure 4:
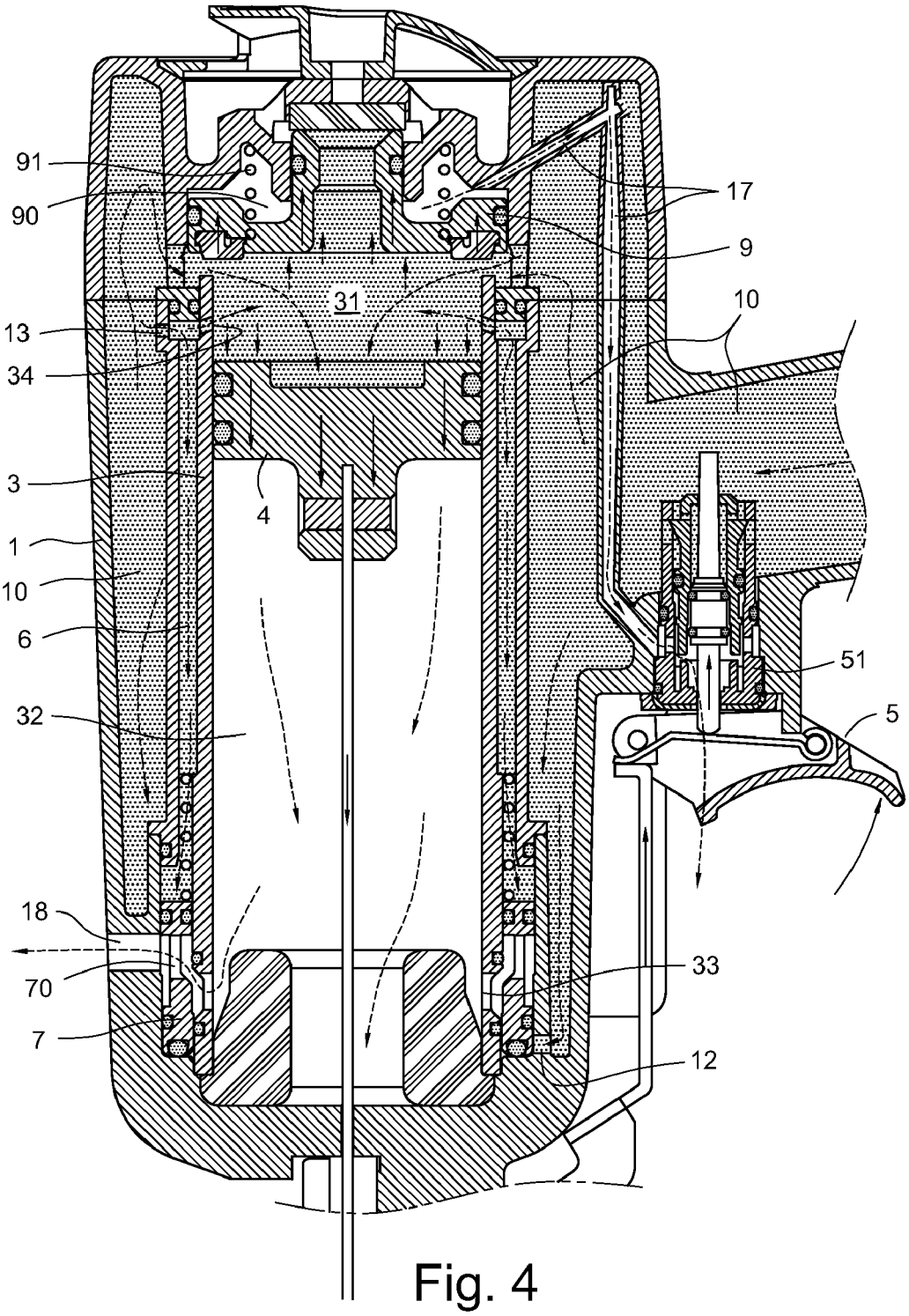
FIG. 4 shows another cross-sectional view of the pneumatical nail gun of FIG. 1, showing a state of the high pressure air being exhausted from the top chamber by a trigger valve to drive a hitting piston downwardly to hit nails, when a trigger is pressed.
Figure 5:
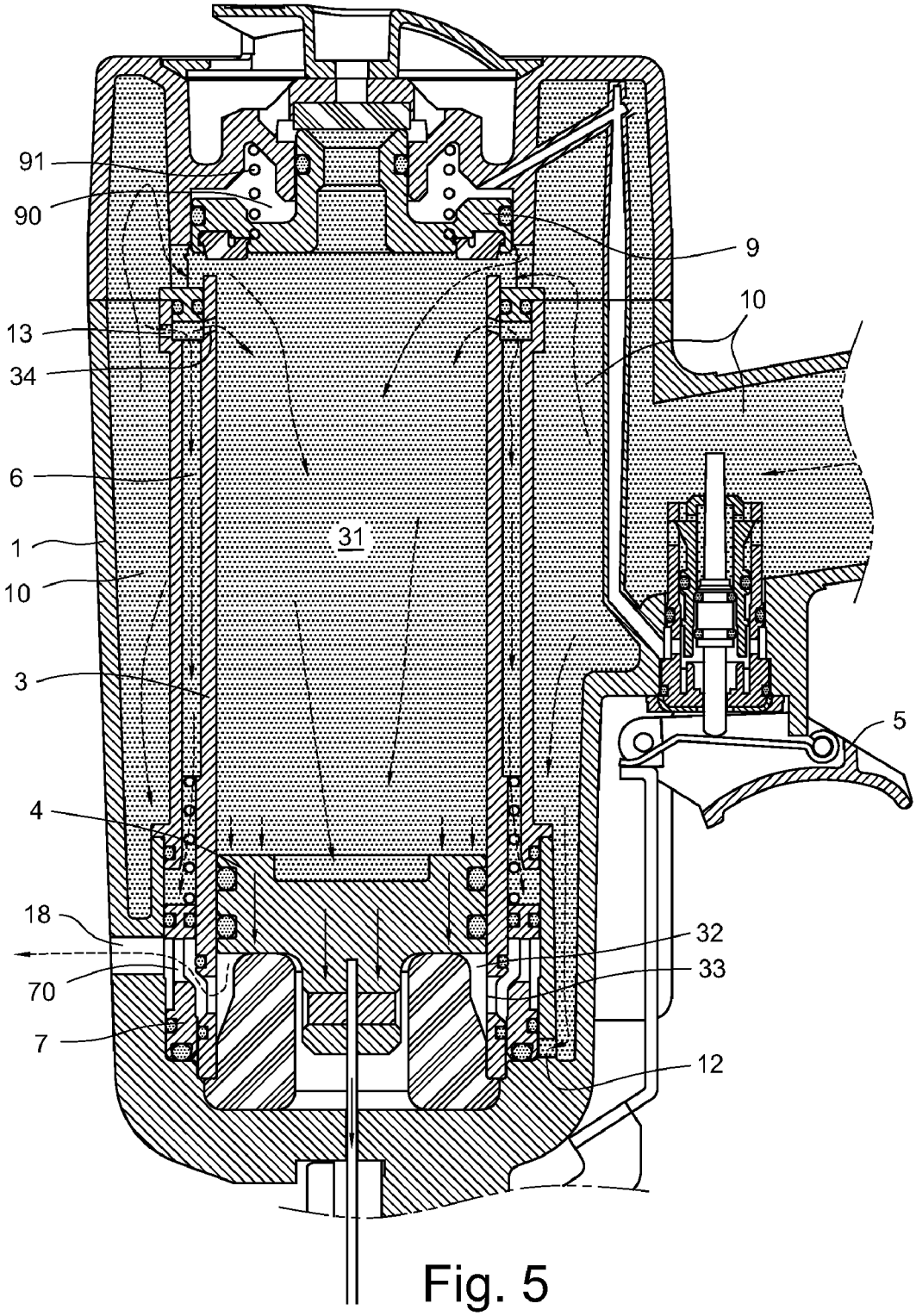
FIG. 5 shows further another cross-sectional view of the pneumatical nail gun of FIG. 1, showing a state of the residual high pressure air compressed in the bottom chamber being exhausted to atmosphere during the press of hitting nails.

When the trigger 5 is pulled as shown in FIG. 4, the trigger valve 51 closes the fluid communication between the main air housing 10 and the trigger passage 17, and the trigger passage 17 is connected to the atmosphere. Compressed high pressure air in the upper chamber 90 is discharged to the atmosphere, so that high pressure air in the main air housing 10 overcome the force of the top spring 91 to drive the head valve 9 to upwardly move to close the fluid communication of the top exhausting hole 19, and continuously introduces high pressure air from the main air housing 10 into the top chamber 31, for driving the hitting piston 4 rapidly downwardly move to hit nails (shown in FIG. 5). The residual air in the bottom chamber 32 may discharged to the atmosphere via the bottom valve hole 33, the guiding hole 70 disposed on the bottom valve 7, and the exhausting hole 18 disposed at a bottom portion of the gun body 1. During the presses of hitting nails, the top vent hole 34 is opened to guiding very little the high pressure air in the main air housing 10 into the top air chamber 31 via the main passage 6.

Figure 6:
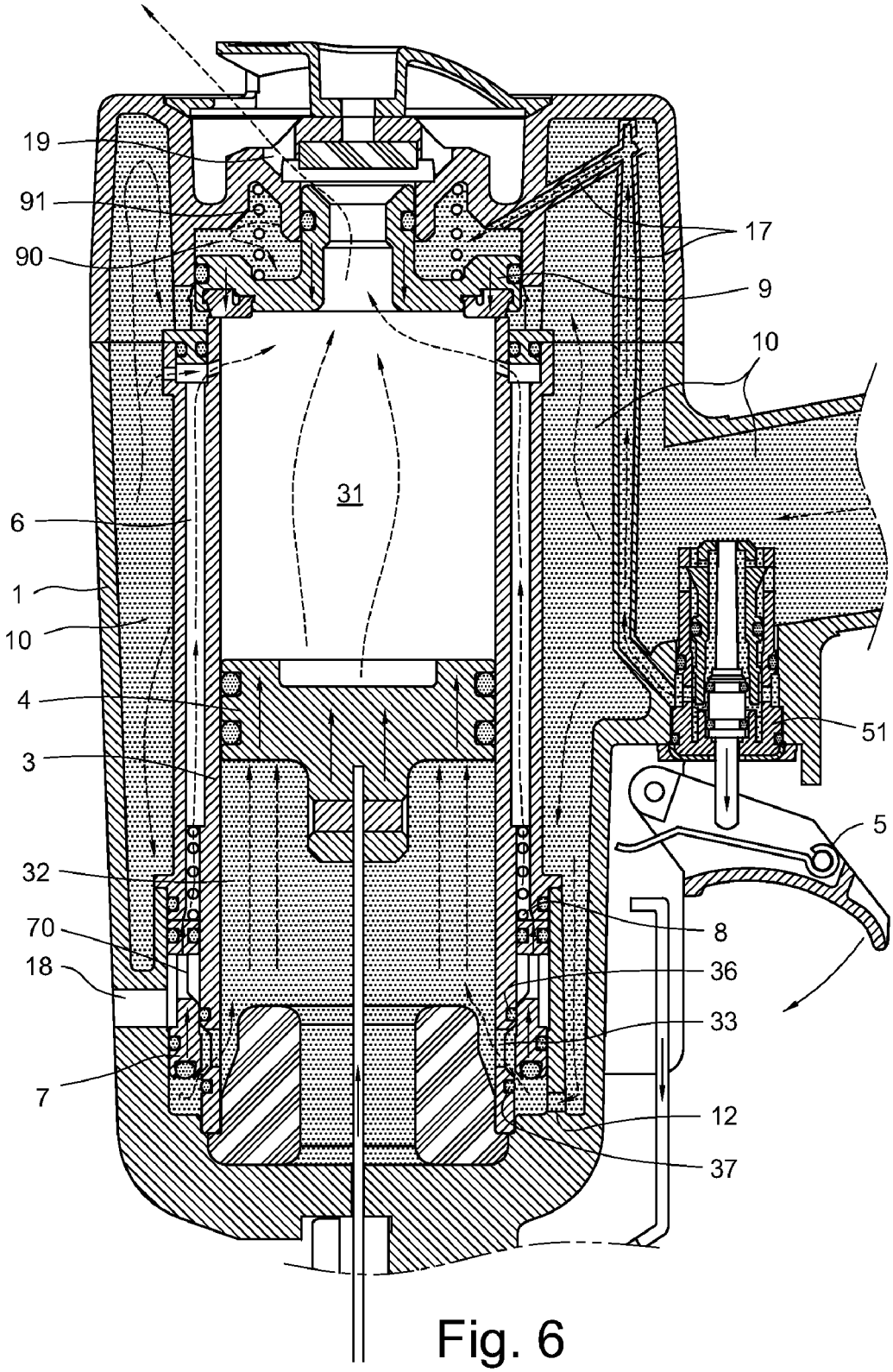
FIG. 6 shows further another cross-sectional view of the pneumatical nail gun of FIG. 1, showing a state after the trigger is released, wherein the high pressure air in the main passage and the top chamber are exhausted so as to drive the bottom valve upwardly move, and high pressure air are introduced into the bottom chamber to drive the hitting piston rapidly upwardly move to reposit.

Then, when the user releases the trigger 14 as shown in FIG. 6, the trigger valve 51 returns to the original open state so that the upper chamber 90 re-collects high-pressure air. The high pressure air and the top spring 91 cooperatively drive the head valve 9 to downwardly move to open the air flow passage of the top exhausting hole 19, and to close the fluid communication between the main air housing 10 and the top chamber 31. The compressed high pressure air in the top chamber 31 and the main passage 6 may discharge to atmosphere via the top exhausting hole 19 to decrease the air pressure in the main passage 6. The high pressure air introduced in to the bottom portion of the bottom valve 7 via the bottom through hole 12 may drive the bottom valve 7 upwardly move. The air tight rings 36 and 37 disposed adjacent to the valve hole 33 close the fluid communication between the bottom valve 33 and the exhausting hole 18 via the guiding hole 70, and open the fluid communication between the bottom valve hole 33 and the bottom through hole 12 so as to introduce the high pressure air from the main air housing 10 into the bottom chamber 32 for rapidly and stably driving the hitting piston 4 upwardly move.

When the hitting piston 4 is reposited, the top vent holes 34 is closed to continuously guiding the high pressure air in the main air housing 10 to gather into the main passage 6, so as to directly drive the bottom valve 7 downwardly move. The fluid communication from the main air housing 10 to the bottom chamber 32 is closed. The trigger 5 is reposited, thus a single shot cycle is terminated.

When the area of the bottom valve 7 induced by the compressed high pressure air in the main passage 6 and the lower chamber 15 is larger than the area adjacent to the bottom valve 7 induced by the compressed high pressure air in the main air housing 10, the bottom spring 8 may be omitted.

Therefore, from above description, it is known that in the above embodiment of the present invention, the pneumatic nail gun utilizes the main passage and bottom valve to continuously guide the compressed high pressure air into the bottom chamber to realize the stably and rapidly upward movement of the hitting piston. The pneumatic nail gun is facilitate utilization thereof, and it can also save the space inside the nail gun to distribute mechanism as well as has a simple air flow passage distribution to ensure the nail gun having a lower cost.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pneumatic nail gun comprising:

a gun body having a unmovable cylinder therein a hitting piston disposed in the cylinder to divide the cylinder into a top chamber and a bottom chamber a main air housing collecting a compressed high pressure air with a constant pressure and a trigger at one end of the main air housing driving the high pressure air to hit a nail;

at least one main passage disposed at a peripheral portion of the cylinder or a side of the main air housing, the at least one main passage being connected with the main air housing for introducing and gathering high pressure air therein, the high pressure air in the main passage being discharged after the hitting piston hitting the nail before reposting;

at least one top valve hole disposed adjacent to a top portion of the cylinder;

at least one top through hole disposed at a side of the main passage, and the top through hole having a cross-section smaller than that of the top valve hole and being used for continuously guiding the high pressure air from the main air housing into the main passage; and a bottom valve disposed at a bottom peripheral portion of the cylinder, the bottom valve being driven to upwardly move for continuously guiding high pressure air into the bottom chamber of the cylinder to drive the hitting piston upwardly move to reposit when the trigger is released, the high pressure air in the main passage being recharged, and the bottom valve being driven by the high pressure air gathered in the main passage to move downward to reposit after the hitting piston being reposited.

2. The pneumatic nail gun as claimed in claim 1, further comprising at least one bottom through hole disposed at a bottom portion in the gun body adjacent to a bottom portion of the bottom valve, after the hitting piston moving downward to hit nails and when the top chamber being closed with main air housing, the bottom through hole being used for guiding the high pressure air in the main air housing to drive the bottom valve to upwardly move; and a plurality of bottom valve holes disposed at outside surface of the gun body adjacent to a bottom portion thereof, when the bottom valve moving downward to reposit, the bottom valve holes shuts off the fluid communication of the high pressure air into the bottom chamber.

3. The pneumatic nail gun as claimed in claim 1, wherein the top valve hole is opened when the hitting piston moves down to hit nails and before reposition, the high pressure air in the main passage are exhausted, when the hitting piston reposits, the top valve hole is closed to gather high pressure air in the main passage.

4. The pneumatic nail gun as claimed in claim 1, wherein the main passage is disposed between an outside surface of the cylinder and a side wall of the gun body, and the side wall is disposed between the main passage and the main air housing, and the top through hole is disposed on the side wall of the gun body.

5. The pneumatic nail gun as claimed in claim 1, wherein the top valve hole is taken as one end of the main passage, a top portion of the top chamber extended to form a concave chamber connected with the top valve hole, and a valve bolt is extended from a top portion of the piston, which is capable of passing in and out of the concave chamber for controlling open and close of the top valve hole.

6. The pneumatic nail gun as claimed in claim 5, wherein the main passage is disposed at an outside of a rib wall in the gun body that formed by the main air housing, and the top through hole is disposed on the rib wall.

7. The pneumatic nail gun as claimed in claim 1, wherein the top valve hole is taken as one end of the main passage, and is connected with side walls of a top portion of the cylinder for controlling open and close of the hitting piston.

8. The pneumatic nail gun as claimed in claim 1, further comprising a lower chamber disposed upon the bottom valve and between the peripheral portion of the cylinder and the inner walls of the gun body, the lower chamber being connected with the main passage for gathering high pressure air to drive the bottom valve to downwardly move to reposit.

9. The pneumatic nail gun as claimed in claim 8, further comprising a bottom spring installing in the lower chamber and abutting the bottom valve, and the bottom spring having a push force less than that of the high pressure air gathering in the main air housing for driving the bottom valve upwardly move.

10. The pneumatic nail gun as claimed in claim 1, wherein the bottom valve is abutted by a spring, and the spring has a push force less than that of the high pressure air gathering in the main air housing for driving the bottom valve upwardly move.

* * * * *